US007108037B1

(12) United States Patent
Ebeling

(10) Patent No.: US 7,108,037 B1
(45) Date of Patent: Sep. 19, 2006

(54) LOCK MECHANISM FOR RETRACTABLE AWNING

(75) Inventor: Franklin D. Ebeling, Plainview, TX (US)

(73) Assignee: R.V. Specialties, Inc., Irving, TX (US)

( * ) Notice: Subject to any disclaimer, the term of this patent is extended or adjusted under 35 U.S.C. 154(b) by 169 days.

(21) Appl. No.: 10/792,381

(22) Filed: Mar. 4, 2004

Related U.S. Application Data

(60) Provisional application No. 60/451,542, filed on Mar. 4, 2003.

(51) Int. Cl.
*E04F 10/06* (2006.01)

(52) U.S. Cl. ..... 160/67; 160/298; 248/229.1

(58) Field of Classification Search ..... 160/298, 160/291, 299, 66, 67, 73, 81; 248/229.1, 248/229.12, 229.17, 229.22
See application file for complete search history.

(56) References Cited

U.S. PATENT DOCUMENTS 1,098,822 A * 6/1914 Miller ..... 248/229.1
1,176,203 A * 3/1916 Comer ..... 248/229.12
1,591,371 A * 7/1926 Franz ..... 160/298
2,166,745 A 7/1939 Appel
2,492,816 A 12/1949 Rosman
4,607,654 A 8/1986 Duda
4,658,877 A 4/1987 Quinn
4,705,148 A 11/1987 Zindler
4,759,396 A * 7/1988 Quinn ..... 160/66
5,163,460 A 11/1992 Miller
5,423,506 A 6/1995 Spoon
5,752,536 A 5/1998 Becker
5,848,629 A 12/1998 Baka
5,860,440 A 1/1999 Murray et al.
6,206,078 B1 3/2001 Frey, Jr.
6,625,936 B1 9/2003 Schmitz
6,792,993 B1 * 9/2004 Forbes ..... 160/67

* cited by examiner

*Primary Examiner*—Blair M. Johnson
(74) *Attorney, Agent, or Firm*—Shlesinger Arkwright & Garvey LLP

(57) ABSTRACT

A device for preventing a roller mounted retractable awning from deploying comprising a mounting bracket adapted to secure the device to the support arm of an awning, a locking band configured to encircle the awning roller, an extension member provided between and interconnecting the mounting bracket and the locking band so that said locking band is aligned transverse to the longitudinal axis of the mounting bracket and an actuator operatively associated with the locking band for engaging a roller of a retractable awning to prevent rotation and deployment of the awning.

13 Claims, 2 Drawing Sheets

LOCK MECHANISM FOR RETRACTABLE AWNING

CROSS-REFERENCE TO RELATED APPLICATIONS

This application is based upon co-pending provisional application Ser. No. 60/451,542 filed on Mar. 4, 2003.

FIELD OF THE INVENTION

The present invention relates to locks and in particular, a locking device for securing a retractable awning of a recreational vehicle.

BACKGROUND OF THE INVENTION

Locking devices for retractable awnings on a recreational vehicle are known. The lock prevents rotation of the awning drum when the awning is in a retracted position. Th awning is prevented from deploying when the recreational vehicle is being driven along a highway.

For example, U.S. Pat. No. 6,206,078 to Frey, Jr. and U.S. Pat. No. 4,759,396 to Quinn disclose recreational vehicle awning locks having ratchet mechanism for locking the drum. U.S. Pat. No. 4,705,148 to Zindler discloses a recreational vehicle awning lock having a clutch brake within the drum whereas U.S. Pat. No. 5,848,629 provides a pair of locking pawl in the drum.

Because the prior art locks are complicated, they are expensive to manufacture. Complex lock designs also require careful maintenance due to the great number of moving parts. Further, because an awning lock on a recreational vehicle is subjected to substantial vibration and stress and exposure to variable weather conditions, the complex lock designs of the prior art are subjected to frequent failure. In addition, none of the prior art awning locks are adapted for use on a pre-existing awning that has already been installed on a recreational vehicle. Rather, the prior art locks require replacement of the entire awning with a new awning having and integral lock. This is not desirable for obvious reasons. Finally, prior art awning locks are not easily adapted to be removed from an awning. In those instances where the prior art lock is somehow removed from the awning, the roller tube or the recreational vehicle is usually damaged by permanent screw holes drilled into the recreational vehicle or the upright arm of the awning.

BRIEF SUMMARY OF THE INVENTION

A device for preventing a roller mounted retractable awning from deploying comprising a mounting bracket adapted to secure the device to the support arm of an awning, a locking band configured to encircle the awning roller, an extension member provided between and interconnecting the mounting bracket and the locking band so that said locking band is aligned transverse to the longitudinal axis of the mounting bracket and an actuator operatively associated with the locking band for engaging a roller of a retractable awning to prevent rotation and deployment of the awning.

The present invention is also directed to an awning assembly provided with a locking device which presents the awning from deploying when the recreational vehicle is moving.

The object of the present invention is to provide an awning lock having none of the disadvantages noted earlier in connection with the prior art devices.

DETAILED DESCRIPTION OF THE PREFERRED EMBODIMENTS

Figure 1:
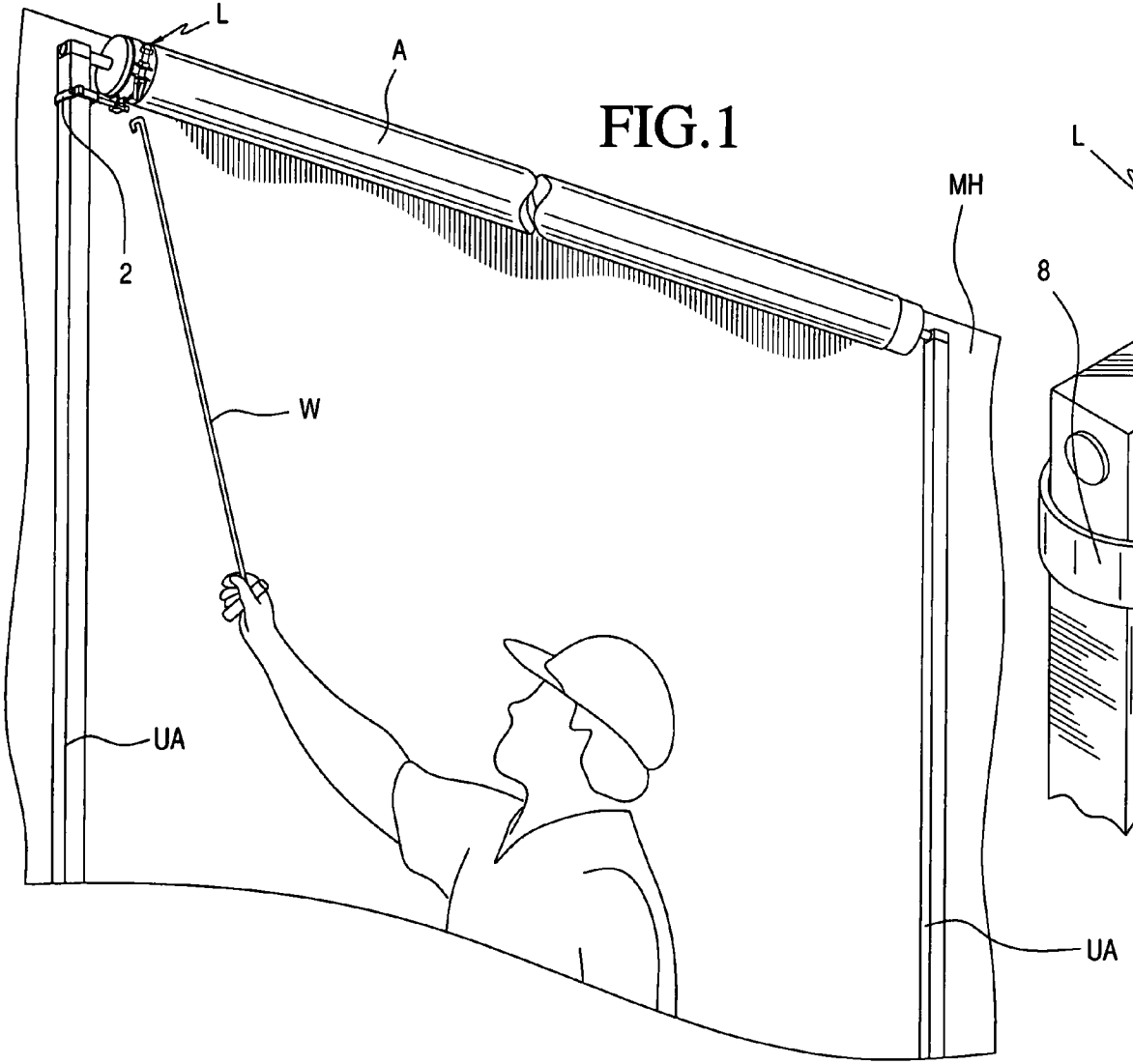
FIG. 1 is a perspective view of the awning lock according to the present invention attached to an awning of a recreational vehicle and showing a user grasping an extension wand for actuating the awning lock.

FIG. 1 illustrates a first embodiment of a locking device L according to the present invention shown attached to a retractable awning A of a recreational vehicle MB.

Figure 2:
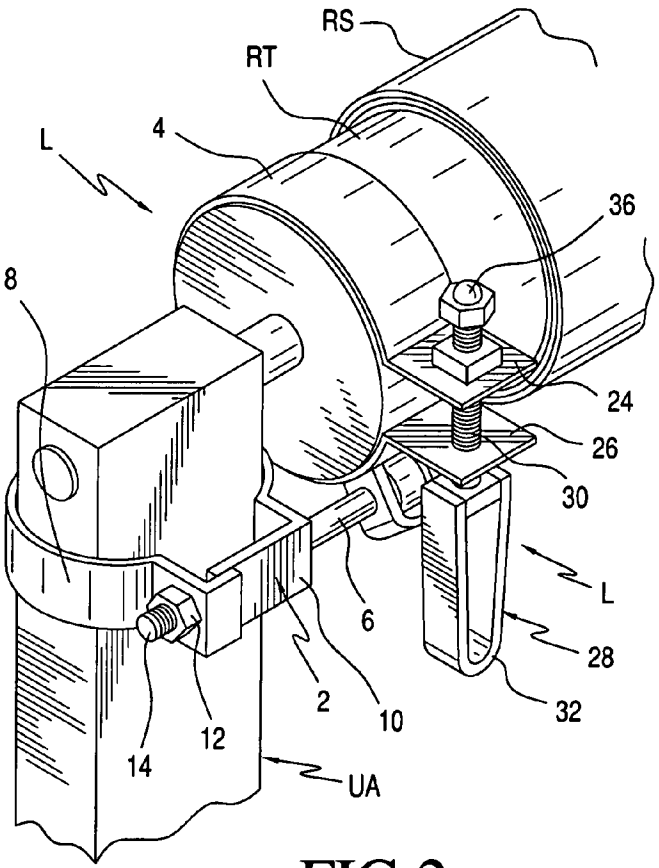
FIG. 2 is an enlarged perspective view of the awning lock shown in FIG. 1.
Figure 3:
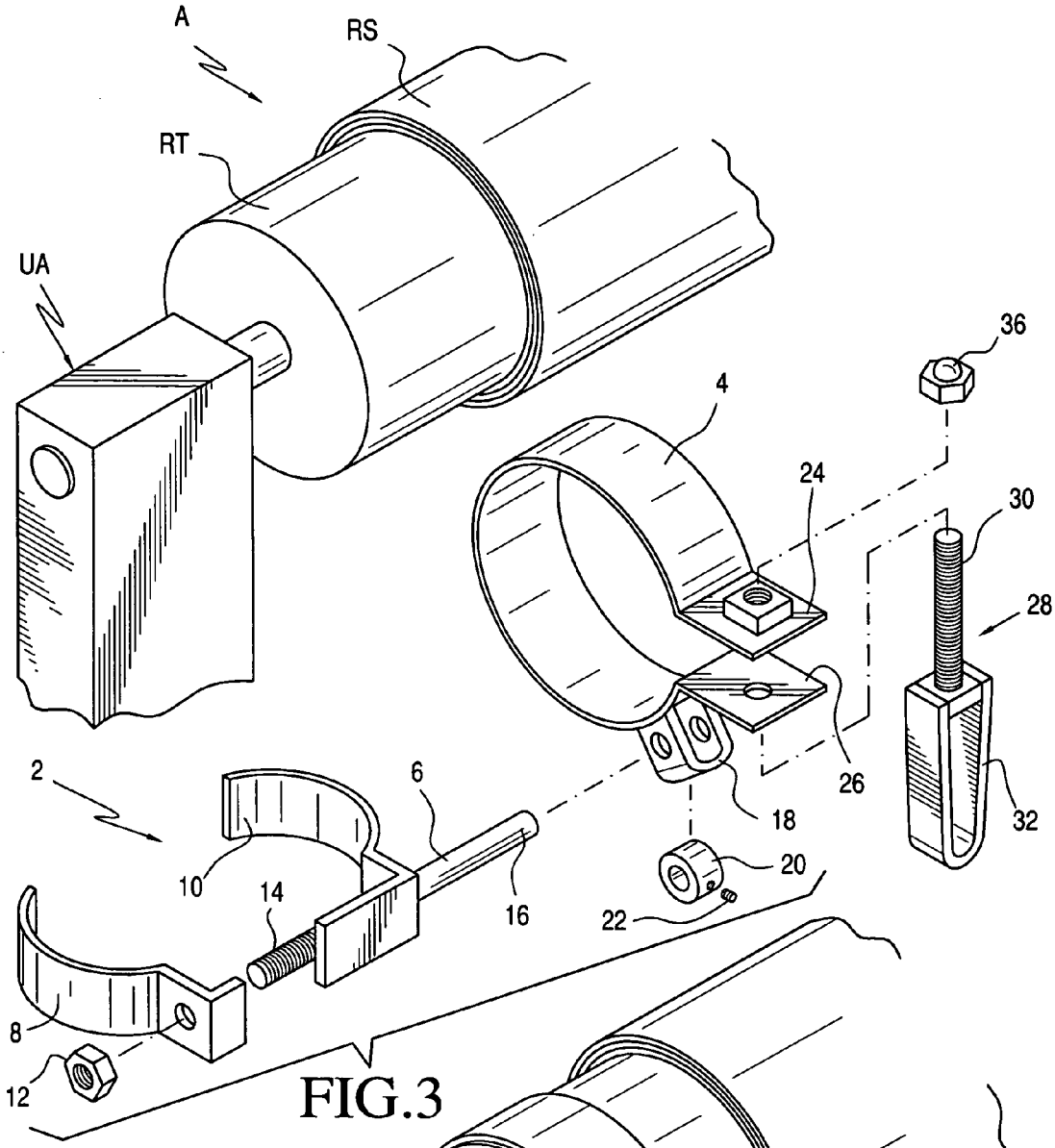
FIG. 3 is an exploded perspective view of the awning lock shown in FIG. 2 together with a fragmentary view of an awning device.

FIGS. 2 and 3 show the locking device L in greater detail. A typical awning A having a retractable shade RS is shown in a retracted position on an awning roller tube or drum RT which is mounted at each end within an end cap (not shown) that secures the roller tube RT at each end to an upright support arm UA for axial rotation. The present invention is adapted for use in connection with retractable awnings other than that as shown so long as the awning structure includes a roller tube or similar structure upon which the shade is rolled into a retracted position.

The locking device L is shown to comprise a clamp member 2 and locking band 4 that are interconnected by an extension member 6. Clamp member 2 is adapted to rigidly attach the locking device L to an upright support arm UA. The clamp member 2 is shown in the drawings to be a two piece bracket having cooperating first and second clamping members 8 and 10 configured to surround the upright support arm UA. As is apparent, it is within the scope fo the present invention to vary the shape of the clamp member 2 from that as shown and adapt it to a upright support arm having a different construction. The clamp member is required to provide a connection to the upright support member that is rigid so that the locking band 4 may function to positively lock the awning in the manner described below in greater detail.

The first and second brackets 8 and 10 of clamp member 2 are secured together by a connecting member shown in the drawings to be a locking nut 12 engaged with a treaded end 14 of extension member 6. As is apparent, other types of interconnection for the first and second bracket are within the scope of the present invention so long as the connection allows the brackets to be tightly secured together. For example, the end 14 of the extension member 6 may be integral with clamp member 2 or otherwise welded to the clamp member 2 and a separate screw or tightening device is provided to secure the clamp member 2 to the upright support arm UA and having no association with the extension member 6.

The opposite end 16 of extension member 6 is adjustably secured to the locking band 4 at a receiving member or bracket 18 extending from the locking band 4. The opposite end 16 of the extension member 6 is fitted within receiving member or bracket 18 and held in place within the receiving member 18 with a collar 20 and set screw 22 unit. The longitudinal axis of the clamp member 2 (which is coaxially aligned with the longitudinal axis of the upright support arm UA) is therefore disposed and maintained transverse to the longitudinal axis of the locking band 4 (which is coaxially aligned with the longitudinal axis of the roller tube or drum RT). The provision of a receiving member 18 in combination with a collar and set screw unit as shown allows a user to repositioned the locking band along the length of the roller RT if so desired.

The locking band 4 comprises a generally flat band of sheet material terminating at cooperating flange members 24 and 26. The width of the band is variable from that shown in the drawings but the length should be sufficient to substantially surround the roller tube RT of the awning A to be locked. The width of the locking band 4 may be increased or decreased depending upon the application. For example, a locking band 4 having a greater width provides greater surface contact with the roller tube 4 and thus may be appropriate for larger awning applications.

Figure 4:
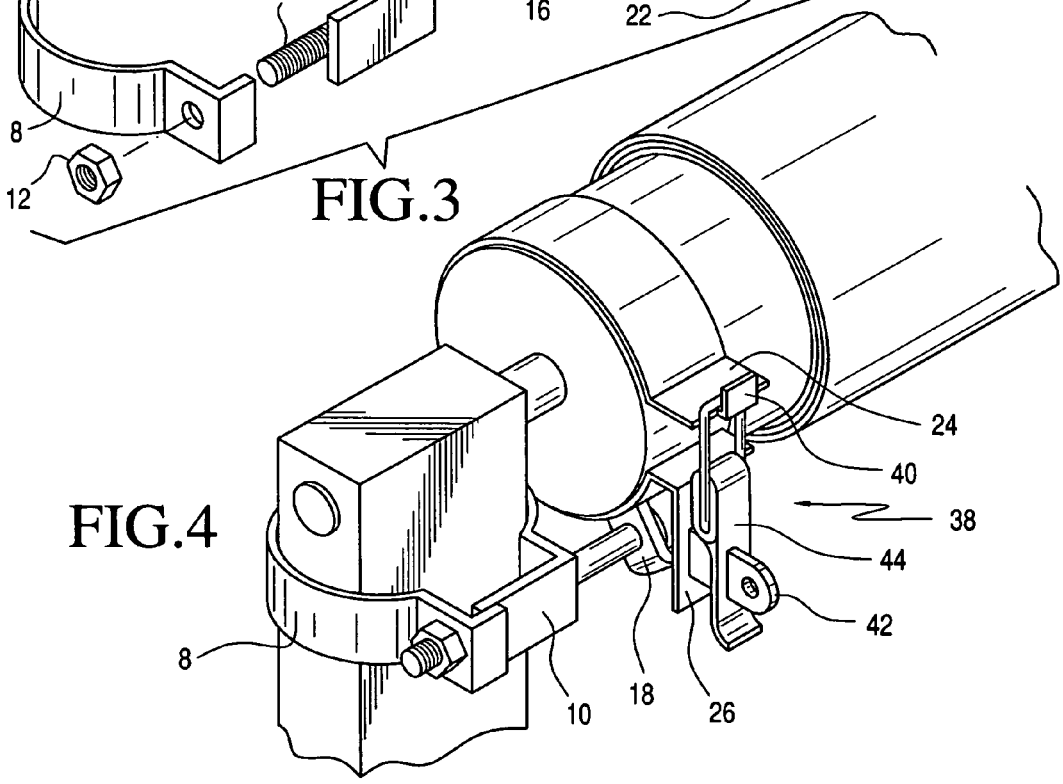
FIG. 4 is an enlarged perspective view of an alternative embodiment of the awning lock according to the present invention.

Each of flange members 24 and 26 are provided with a passageway that extends through the flange and which is adapted to receive a locking actuator 28 operatively associated with the locking band 4. In one embodiment of the present invention, the locking actuator 28 is a threaded eye bolt as depicted in FIG. 3 and comprises a threaded portion 30 and eye portion 32. As best shown in FIGS. 2 and 3, the threaded portion is received within the passageways of the respective flange members 24 and 26 enclosing the end of roller tube RT of the awning A. Flange member 24 contains a bolt 34 which cooperates with the threaded portion 30 of the locking actuator 28. An end cap 36 is provided on the end of the threaded portion 30. As is apparent, rotation of the locking actuator 28 will cause locking band 4 to be selectively tightened around the roller tube RT effectively and positively locking it into place. In another embodiment of the invention shown in FIG. 4, the threaded eye bolt is replaced with a over the center latch mechanism 38. In this embodiment, the passageways associated with flange members 24 and 26 are removed and replaced with a catch 40 and extension member 42 respectively. The extension member 42 is received within a slot of pivoting latch element which engages the catch 40 to lock the band 4 against the roller tube. Although this actuator does not selectively adjust the locking tension as in the case of the earlier embodiment, it is adapted to receive a padlock (not shown) or other securing device through the extension member 42.

Turning to FIG. 1, a user is shown holding a wand W that is inserted within the threaded eye bolt of the locking actuator 28 and then rotated to selectively tighten the locking band 4 against the roller tube RT of an awning prior to moving of the recreational vehicle. Conversely, the locking actuator 28 may be rotated to loosen the locking band 4 from the roller tube thereby allowing the roller tube to rotate and the shade deployed from a retracted position.

The present invention is readily adapted for use with any retractable awning having an upright support arm UA. Further, the device may be readily removed without any damage to either the awning or the recreational vehicle.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A device for preventing a roller mounted retractable awning from deploying, said device comprising:

a) a mounting bracket, said mounting bracket having two clamping members defining an axis extending therebetween and adapted to secure said device to a supporting structure;

b) a locking band, said locking band configured to encircle a roller of a retractable awning and having an axis extending therethrough;

c) an extension member, said extension member extending between and interconnecting said mounting bracket and said locking band so that the axis of said locking band is aligned transverse to the axis of said mounting bracket; and d) an actuator, said actuator is an eye bolt operatively associated with said locking band for engaging said locking band against a roller of a retractable awning to prevent rotation of the same so that the awning is prevented from deployment, said locking band having first and second opposite ends, at least one of said opposite ends threadedly connected to said actuator so that rotation of said actuator will draw said first and second opposite end together and selectively engage said locking band against a roller of a retractable awning.

2. A device as in claim 1 and wherein said extension member is substantially linear along a longitudinal axis thereof.

3. A device as in claim 1 and wherein said extension member has a sufficient length so that said locking band will only extend to an end portion of a retractable awning roller.

4. A retractable awning and lock assembly comprising:

a) a pair of upright support members;

b) a roller member, said roller member connected between said pair of support members for axial rotation about a longitudinal axis thereof;

c) a flexible awning, said flexible awning adapted to be selectively extended and retracted from said roller member; and d) a roller lock, said roller lock comprising a mounting bracket, said mounting bracket having two clamping members defining an axis extending therebetween and adapted to secure said device to at least one of said pair of upright support members, a locking band, said locking band configured to encircle said roller member and having an axis extending therethrough, an extension member, said extension member extending between and interconnecting said mounting bracket and said locking band so that the axis of said locking band is aligned transverse to the axis of said mounting bracket and an actuator, said actuator is an eye bolt operatively associated with said locking band for engaging said locking band against said roller member so that said flexible awning is prevented from deployment, wherein said locking band having first and second opposite ends, at least one of said opposite ends threadedly connected to said actuator so that rotation of said actuator will draw said first and second opposite end together and selectively engage said locking band against said roller member.

5. A device as in claim 4 and wherein said extension member is substantially linear along a longitudinal axis thereof.

6. A device as in claim 4 and wherein said extension member has a sufficient length so that said locking band will only extend to an end portion of said roller member.

7. A retractable awning and lock assembly comprising:

a) a pair of upright support members;

b) a roller member, said roller member connected between said pair of support members for axial rotation about a longitudinal axis thereof;

c) a flexible awning, said flexible awning adapted to be selectively extended and retracted from said roller member; and d) a roller lock, said roller lock comprising a mounting bracket, said mounting bracket having two clamping members defining an axis extending therebetween and adapted to secure said device to at least one of said pair of upright support members, a locking band, said locking band configured to encircle said roller member and having an axis extending therethrough, an extension member having first and second opposite ends, said extension member extending between and interconnecting said mounting bracket and said locking band so that the axis of said locking band is aligned transverse to the axis of said mounting bracket and an actuator, said actuator operatively associated with said locking band for engaging said locking band against said roller member so that said flexible awning is prevented from deployment and wherein one of said extension member first and second opposite ends is adjustably connected to said locking band so that the position of said locking band relative to said mounting bracket may be selectively changed.

8. A retractable awning and lock assembly comprising:

a) a pair of upright support members;

b) a roller member, said roller member connected between said pair of support members for axial rotation about a longitudinal axis thereof;

c) a flexible awning, said flexible awning adapted to be selectively extended and retracted from said roller member; and d) a roller lock, said roller lock comprising a mounting bracket, said mounting bracket having two clamping members defining an axis extending therebetween and adapted to secure said device to at least one of said pair of upright support members, a locking band, said locking band configured to encircle said roller member, an extension member and having an axis extending therethrough having first and second opposite ends, said extension member extending between and interconnecting said mounting bracket and said locking band so that the axis of said locking band is aligned transverse to the axis of said mounting bracket and an actuator, said actuator operatively associated with said locking band for engaging said locking band against said roller member so that said flexible awning is prevented from deployment and wherein said locking band having a bracket and set collar for receiving one of said extension members first and second opposite ends and connecting said locking band thereto at a selected position thereon.

9. A device for preventing a roller mounted retractable awning from deploying, said device comprising:

a) a mounting bracket, said mounting bracket having two clamping members defining an axis extending therebetween and adapted to secure said device to a supporting structure;

b) a locking band, said locking band configured to encircle a roller of a retractable awning and having an axis therethrough;

c) an extension member having first and second opposite ends, said extension member extending between and interconnecting said mounting bracket and said locking band so that the axis of said locking band is aligned transverse to the axis of said mounting bracket; and d) an actuator, said actuator operatively associated with said locking band for engaging said locking band against a roller of a retractable awning to prevent rotation of the same so that the awning is prevented from deployment wherein said locking band having a bracket and set collar for receiving one of said extension members first and second opposite ends and connecting said locking band thereto at a selected position thereon.

10. A device as in claim 9 and wherein said locking band having first and second opposite ends and said actuator is a latch mechanism adapted to latch together said first and second opposite ends to thereby selectively engage said locking band against a roller of a retractable awning.

11. A device as in claim 9 and wherein said actuator is an eye bolt.

12. A device as in claim 9 and wherein one of said extension member first and second opposite ends is received by said two clamping members to interconnect the same while also connecting said extension member to said mounting bracket.

13. A device as in claim 9 and wherein one of said extension member first and second opposite ends is adjustably connected to said locking band so that the position of said locking band relative to said mounting bracket may be selectively changed.

* * * * *